US005376911A

United States Patent [19]

Stenkvist

[11] Patent Number: 5,376,911

[45] Date of Patent: Dec. 27, 1994

[54] CHOKE COIL

[75] Inventor: Sven-Einar Stenkvist, Brugg, Switzerland

[73] Assignee: Asea Brown Boveri Ltd., Baden, Switzerland

[21] Appl. No.: 99,565

[22] Filed: Jul. 30, 1993

[30] Foreign Application Priority Data

Aug. 13, 1992 [DE] Germany ..... 4226764

[51] Int. Cl.[5] ..... H01F 27/08; H01F 27/30

[52] U.S. Cl. ..... 336/60; 336/197; 336/223

[58] Field of Search ..... 336/223, 180, 183, 60, 336/197

[56] References Cited

U.S. PATENT DOCUMENTS

| | | | |
|---|---|---|---|
| 316,354 | 4/1885 | Gauland et al. | 336/223 |
| 1,539,928 | 6/1925 | Angus | 336/223 |
| 3,153,212 | 10/1964 | Davis | 336/223 |
| 4,129,846 | 12/1978 | Yablochnikov | 336/223 |
| 4,814,735 | 3/1989 | Williamson | 336/223 |

FOREIGN PATENT DOCUMENTS

| | | | |
|---|---|---|---|
| 508183 | 9/1930 | Germany . | |
| 423962 | 5/1967 | Switzerland . | |
| 512848 | 10/1971 | Switzerland . | |
| 581514 | 11/1977 | U.S.S.R. | 336/223 |

OTHER PUBLICATIONS

Held, W.; Pollmeir, J.; Neue TFH-Sperren und Abstimmsätze, In: Siemens-Zeitschrift, H.10, S. 613-617; Abschnitt "Bauformen".

DE-Z: elektrowärme international, Ausgabe B, Bd. 41, 1983, H.4,S.B177.

*Primary Examiner*—Thomas J. Kozma

*Attorney, Agent, or Firm*—Oblon, Spivak, McClelland, Maier & Neustadt

[57] ABSTRACT

A choke coil comprises mutually similar flat bars which are electrically connected at the corners. Each coil winding comprises an integral number of mutually similar flat bars which in each case lie on top of one another on contact areas at the corners so as to overlap over a large area. Insulating plates and/or insulating layers having a size approximately equal to the contact area are provided between two adjacent windings at the corners. The stack formed in this way is held together exclusively by means of a clamping device comprising clamping elements which do not cut or pierce the flat bars. A choke constructed in this manner is simple and economical to manufacture can be cooled well and can be produced in virtually any size.

5 Claims, 4 Drawing Sheets

$$\alpha = \frac{180^\circ(\eta-2)}{\eta}$$

$$\alpha = 60^\circ$$

$$\alpha = \frac{180^\circ(\eta-2)}{\eta}$$

$$\alpha = 120^\circ$$

CHOKE COIL

BACKGROUND OF THE INVENTION

Field of the Invention

The invention relates to a choke coil having mutually similar flat bars which are electrically connected at the corners, insulating material being provided between windings situated on top of one another.

Discussion of Background

In order to achieve an adequate time constant, one or two chokes are incorporated in the direct-current circuit in the case of direct-current arc-furnace installations. Type data for such chokes are inductances around 100 μH, which have to be designed for continuous currents of up to 50 kA and over. Under difficult flicker conditions and with high furnace powers, chokes having inductances of up to 700 μH and over are required for rated currents around 110 kA. So that the $I^2R$ losses are still acceptable, copper conductors of large cross section are necessary for this purpose, with the result that a choke of the type last mentioned has a copper weight of around 75 tonnes. There is therefore a great need to produce chokes of this size economically.

In the production of angular coils, which are wound from bars placed on edge, the bending of the bars becomes increasingly more difficult with increasing width and the bars are subjected at the point of bending to a significant material stress which results in substantial cross-section reductions.

In the method disclosed in German Patent Specification 508 183 for producing angular coils for electrical machines from flat bars placed on edge, the bars are cut obliquely at half the corner angle and then butt-soldered together or butt-welded at the full angle. To relieve the stress at the joint position, the oblique cut through the bars is carried out in a dovetail shape.

In another method (Swiss Patent Specification 512 848), the soldering or welding of the butt positions at the corners is eliminated by providing the ends of the flat bars with a joint position in each case which has a bare cut surface by precision punching or precision cutting and then joining the individual sections together electrically and mechanically by pressing the joint positions into one another.

A common feature of both known techniques is the provision of a mechanical and electrical joint between continuous bars or plates.

SUMMARY OF THE INVENTION

Accordingly, one object of the invention is to provide a novel choke coil which is simple and economical to produce. In particular, a minimum of machining of the individual flat bars should be necessary in the process.

According to the invention, this object is achieved by a choke coil, wherein each coil winding comprises an integral multiple of preferably mutually similar flat bars which in each case lie on top of one another on contact areas at the corners so as to overlap over a large area, wherein insulating plates and/or insulating layers having a size approximately equal to the contact area are provided between two adjacent windings at the corners, and wherein the stack formed in this way is held together exclusively by means of a clamping device comprising clamping elements which do not cut or pierce the flat bars.

The advantage of the invention is to be perceived, in particular, in that the flat bars can be cut to length from strip material without material losses. Apart from the removal of punching or cutting burrs, no further machining is necessary. The same applies to the insulating plates for insulating the windings. Nor are any large requirements imposed on the contact areas. It is sufficient to press the finished plate stack together. The large-area contact at the overlapping points results in low current densities (typically 0.05 $A/mm^2$). The choke can, if necessary or advantageous, be assembled directly at the construction site since no complicated welding or soldering operations have to be carried out.

The construction according to the invention automatically results in spacings between the conductors which are adjacent in the direction of the coil axis, which spaces make an effective cooling possible.

The cross section of the coil can be virtually of any desired shape. Preferably, however, it has the cross section of a regular polygon because it is only then that all the flat bars are mutually similar, regular trapeziums having the same base angle $\alpha$ and identical geometry. In this case, the base angle is given by the easily derivable relationship:

$$\alpha=[180^\circ (n-2)]/n,$$

where n is the number of corners of the polygon. The insulating plates and also the contact areas accordingly have lozenge-shaped cross section, with opposite angles of $\alpha$ or $180^\circ-\alpha$.

A particularly simple and economically producible choke coil, which is regarded as the particularly preferred embodiment of the invention, has square cross section and has two parallel-connected flat-bar quadruplets per winding. In a choke of this type, shoulders and/or specially adapted insulating plates are unnecessary.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DESCRIPTION OF THE PREFERRED EMBODIMENTS

Figure 1:
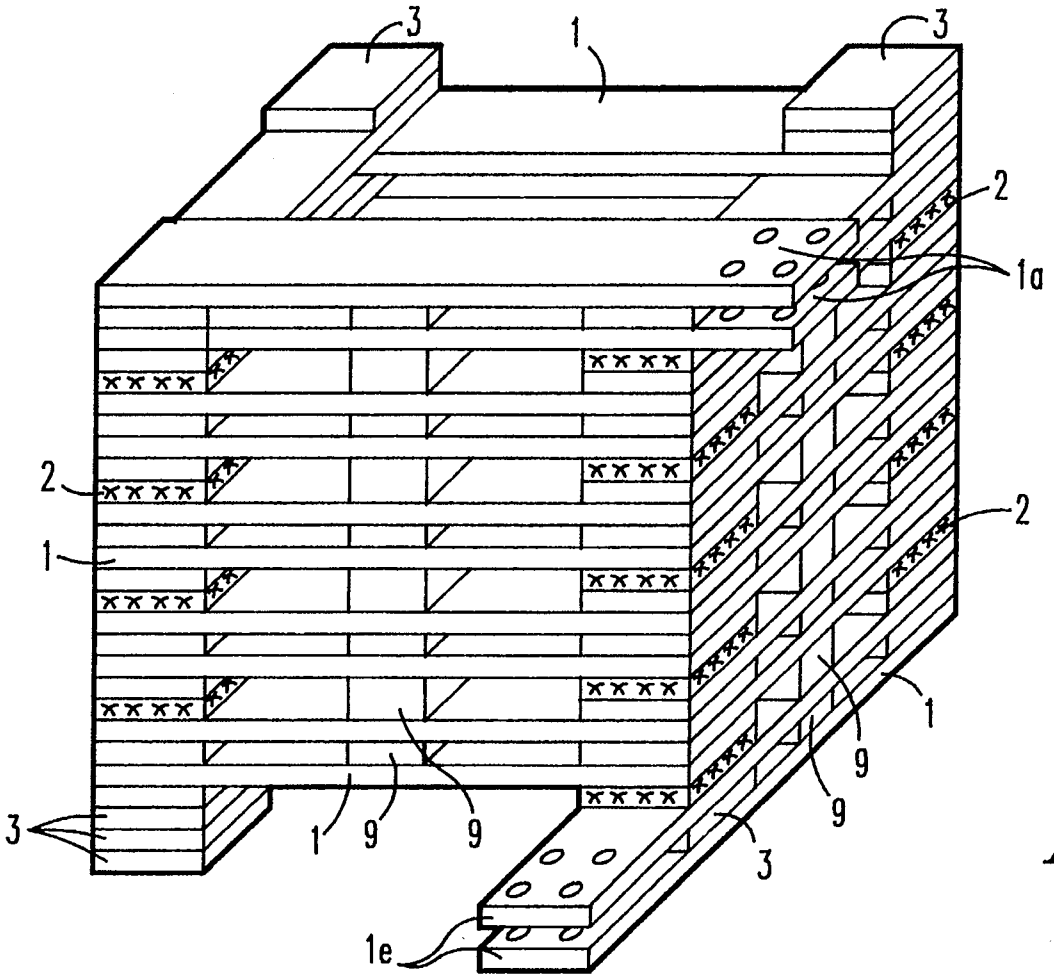
FIG. 1 shows, in a perspective representation, a first preferred exemplary embodiment of a high-power choke coil, in which each winding comprises four flat bars connected in parallel in pairs.

Referring now to the drawings, wherein like reference numerals designate identical or corresponding parts throughout the several views, the choke coil shown in FIG. 1 has a square cross section. It is made up of mutually similar copper plates or flat bars 1 which extend parallel to one another. Only the pair of plates 1*e* at the input and the pair of plates 1*a* at the output have a greater length than the other plates. The plate ends extending beyond the periphery serve as current connections.

Each coil winding comprises a total of four pairs of plates, which in each case lie on top of one another on contact areas at the corners so as to overlap over a large area, which results, as it were, in a parallel connection of two coils wound into one another. Between two adjacent windings (lying on top of one another) insulating plates 2 having a geometry approximately equal to the areas lying on top of one another, the contact area, are in each case provided at the corners. These insulating plates are shown in the drawing with exaggerated thickness. They are composed, for example, of glass-fiber-reinforced plastic, mica, glass mat, thick polyimide films or a combination of the materials mentioned, a thickness of 3 mm being regarded as adequate since the choke is not exposed to any high voltage stresses.

Square plates 3, which are composed, for example, of the conductor metal, or even of insulating material, serve to provide a uniform height of the choke at all four corners or to space the plate pairs at the input and output.

The stack formed in this way is held together exclusively by means of simple clamping elements which do not cut or pierce the flat bars 1 or copper plates.

Figure 2:
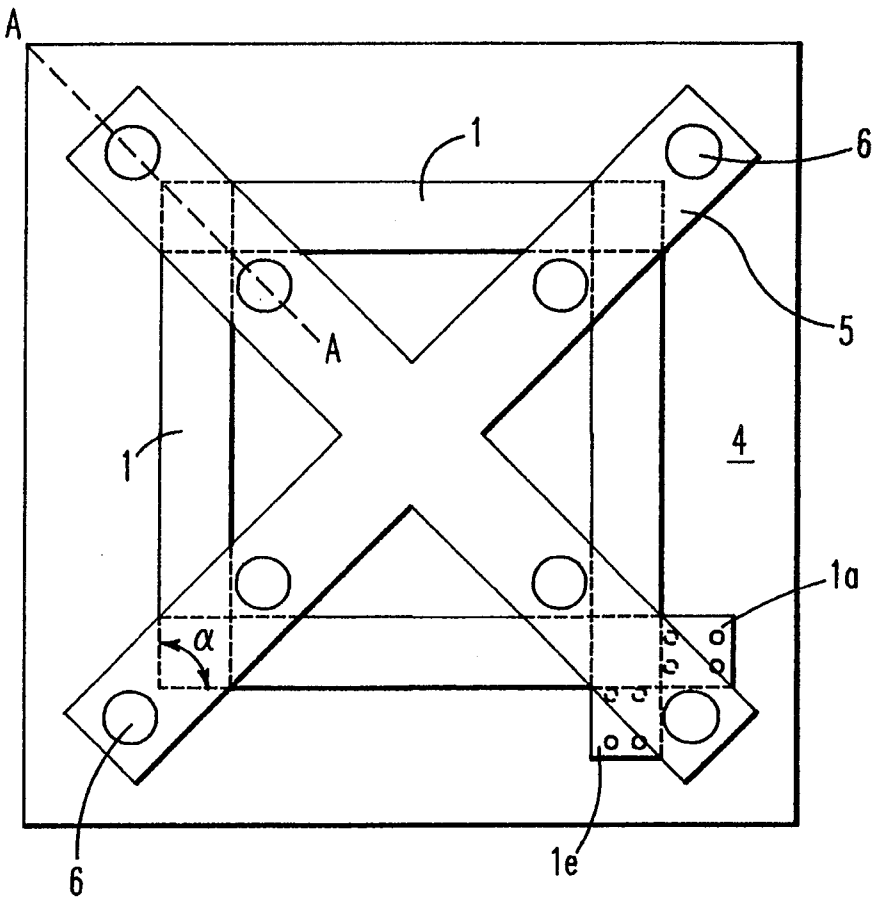
FIG. 2 shows a plan view of the uppermost winding of a choke having square cross section.
Figure 3:
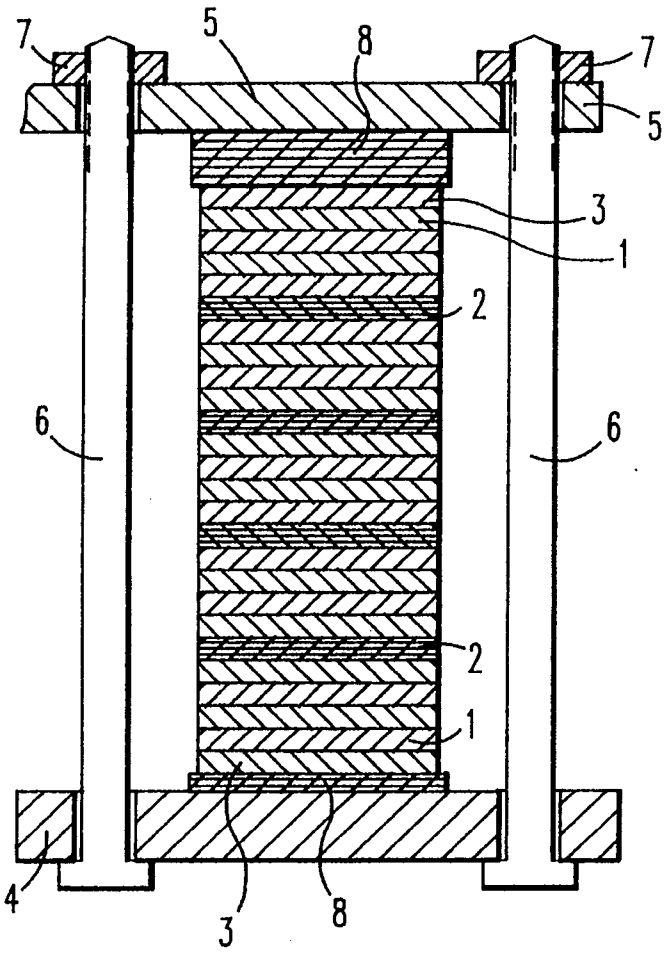
FIG. 3 shows a partial longitudinal section along the line AA through the choke shown in FIG. 2 clamped in a clamping device.

From the diagrammatic plan view of a choke shown in FIG. 2 and the partial longitudinal section through a corner of the choke shown in FIG. 3, the construction of such a clamping device can be seen in grossly simplified form. The clamping device comprises a base plate 4 and a cross-shaped yoke 5, and tie rods 6 with nuts 7 which join the two. Insulating interlayers 8 composed of glass-fiber-reinforced plastic between the plate stack and the base plate 4 or the yoke 5 serve to electrically insulate the choke.

Because the choke is exposed to high magnetic forces during operation, it may be advantageous to insert spacers 9 (FIG. 1) composed of insulating material in the spaces between two conductors lying on top of one another.

A choke having an inductance of 400 $\mu$H and a rated current of 400 kA comprises 20 mm thick copper plates 3500 mm long and 1000 mm thick with 15 windings. For this purpose, $8\times15=120$ plates of this type are required. The total conductor cross section is then 40,000 $mm^2$, which results in a current density of 2.5 $A/mm^2$.

At the same time, the current density in the contact areas is comparatively low and is 0.05 $A/mm^2$ since the copper plates overlap by 2 times 1 $m^2$ at each corner.

Without departing from the scope delineated by the invention, a number of modifications are possible.

Thus, the cross sections of the choke may assume virtually any polygonal cross section, regular polygons being preferred because no waste occurs. The copper plates generally have the shape of an equilateral trapezium having the base angle $\alpha$, this base angle being given by:

$$\alpha=[180^\circ\ (n-2)]/n,$$

wherein n denotes the number of corners of the regular polygon.

In the exemplary embodiment shown in FIG. 1, a choke having a square cross section was chosen. Obviously, the choke may also have any desired rectangular cross section. Other cross sectional shapes are also possible, as shown by the diagrammatic cross sections through a choke having triangular cross section in FIG. 4 and by a choke having hexagonal cross section in FIG. 5.

Figure 4:
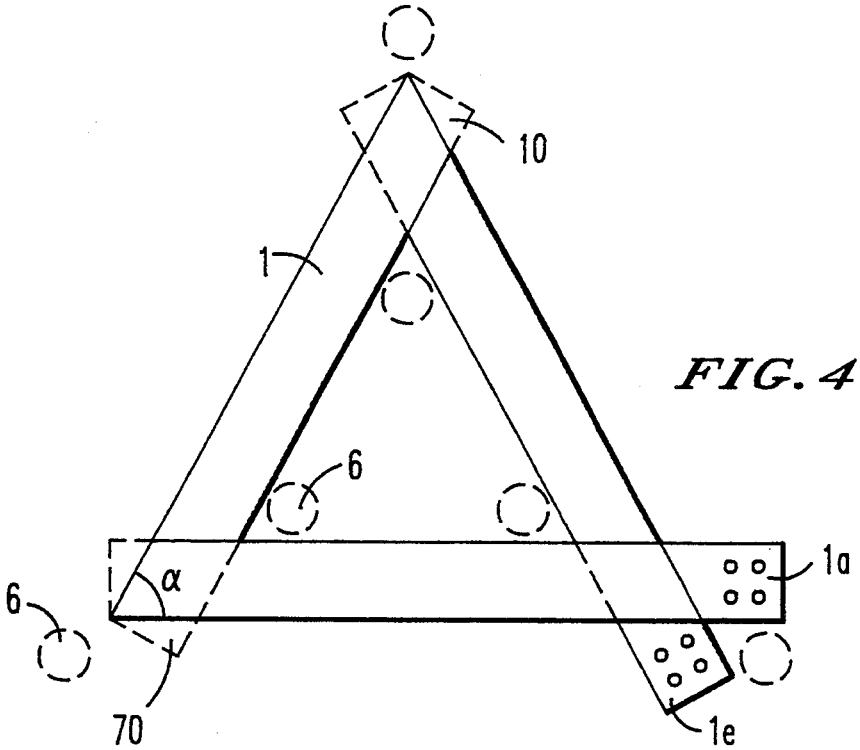
FIG. 4 shows a plan view of the uppermost winding of a choke having the cross section of an equilateral triangle.
Figure 5:
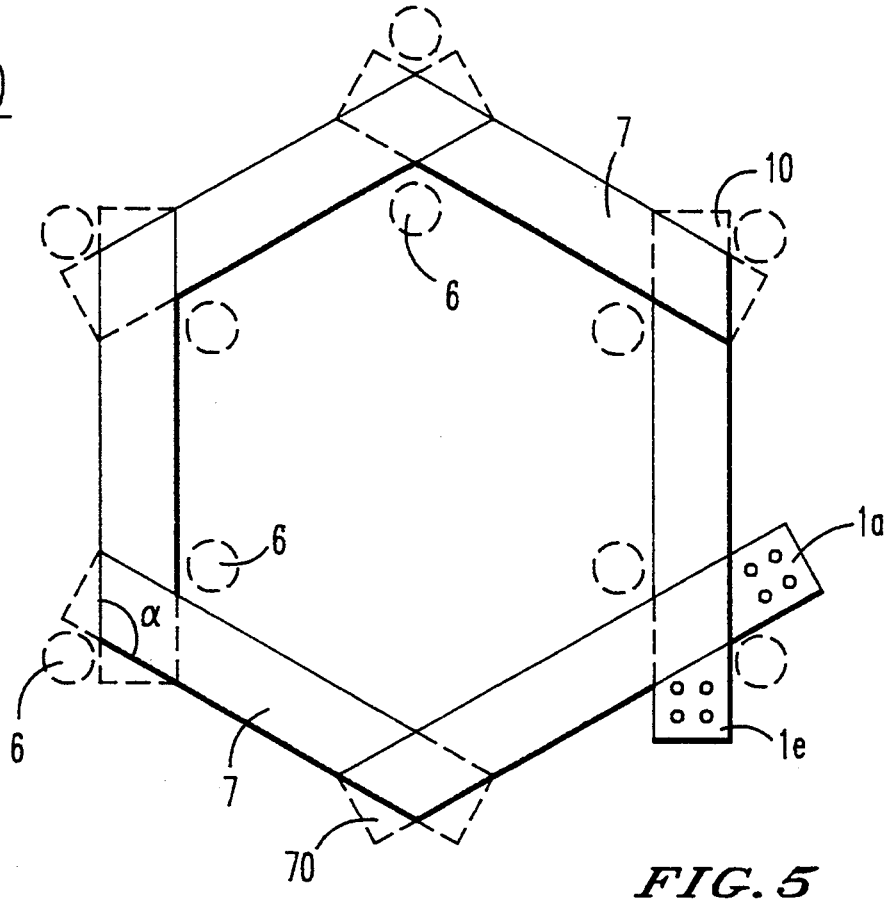
FIG. 5 shows a plan view of the uppermost winding of a choke having the cross section of a regular hexagon.

FIGS. 4 and 5 furthermore make it clear that, in the case of shapes other than the rectangular shape, the copper plates 1 do not necessarily have to be trapezoidal with a base angle of $\alpha<90^\circ$. If the triangular projections 10 (shown by dotted lines in FIGS. 4 and 5) are accepted at the corners, copper plates having rectangular cross section can also be used in such configurations. In such an arrangement, it is then also possible to deviate from the regular polygon and nevertheless get by with mutually identical copper plates.

Because the height increases, in the case of a rectangle (and consequently also of square cross sections), by one plate thickness given the overlapping at each corner with the conductor configuration described, the plates 1 reach the correct height at the next winding without any adaptation or machining. If a conductor configuration with three parallel plates is chosen, the choke must be of hexagonal design, in the case of four parallel plates of octagonal design, etc. It is generally true that, in the case of a choke having the cross section of an n-sided figure (n even and $n>4$), n/2 flat bars must be connected in parallel per winding.

If this "automatic" height adjustment is dispensed with and only one conductor web is used per winding, slight shoulders are produced in the longitudinal direction of the plates 1, which shoulders may possibly make it necessary to reinforce the insulating plates 2. There is no need to fear an impairment of the operating safety, however, because of the ductility of the conductor material.

Obviously, numerous modifications and variations of the present invention are possible in light of the above teachings. It is therefore to be understood that within the scope of the appended claims, the invention may be practiced otherwise than as specifically described herein.

What is claimed as new and desired to be secured by Letters Patent of the United States is:

1. A choke coil having mutually similar flat bars which are electrically connected at corners of the flat bars, insulating material being provided between coil windings situated on top of one another, wherein each coil winding comprises an integral multiple of said mutually similar flat bars which in each case lie on top of one another on contact areas at the corners so as to overlap over a large area, wherein insulating plates and/or insulating layers having a size approximately equal to the contact areas are provided between two adjacent coil windings at the corners, and wherein a stack formed in this way is held together by means of a clamping device comprising clamping elements which do not cut or pierce the flat bars, wherein at least two of said flat bars are connected in parallel per coil winding.

2. A choke coil as claimed in claim 1, wherein, in the case of a choke coil having a cross section of a regular n-sided figure, the flat bars have the cross section of a regular trapezium having a base angle of $$\alpha=[180^\circ\ (n-2)]/n,$$

where n denotes the number of corners of the polygon, and the insulating plates or insulating layers, and also the contact areas have a lozenge-shaped cross section whose opposite angles are of size $\alpha$ or $180°-\alpha$.

3. A choke coil as claimed in claim 1 or 2, wherein the choke coil has a rectangular cross section.

4. A choke coil as claimed in claim 1 or 2, wherein, in the case of a coil having a cross section of an n-sided figure with n even and $n > 4$, n/2 flat bars are connected in parallel per winding.

5. A choke coil as claimed in claim 1, wherein spacers are provided between said parallel flat bars to provide for spacings between the flat bars which permit a cooling of the choke coil.

* * * * *